US006182739B1

(12) United States Patent
Jones

(10) Patent No.: US 6,182,739 B1
(45) Date of Patent: Feb. 6, 2001

(54) SNAP MOUNTED DRAPERY SYSTEM

(76) Inventor: Gary F. Jones, 501 Industrial Rd., Paris, TN (US) 38243

( * ) Notice: Under 35 U.S.C. 154(b), the term of this patent shall be extended for 0 days.

(21) Appl. No.: 09/400,558

(22) Filed: Sep. 21, 1999

Related U.S. Application Data

(63) Continuation-in-part of application No. 29/081,096, filed on Dec. 19, 1997, now Pat. No. Des. 419,815.

(51) Int. Cl.[7] ..... A47H 1/00; A47H 5/00

(52) U.S. Cl. ..... 160/330; 160/345; 16/87.4 R

(58) Field of Search ..... 160/330, 348, 160/344, 345, 329; 16/82.4 R, 94 D, 95 D, 96 D, 87.2

(56) References Cited

U.S. PATENT DOCUMENTS

| | | | | |
|---|---|---|---|---|
| D. 126,700 | | 4/1941 | Freedman | D6/580 |
| 1,828,678 | | 10/1931 | Peterman et al. | 160/349.1 |
| 2,716,448 | | 8/1955 | Landess | 160/173 |
| 2,934,782 | * | 5/1960 | Wootton | 160/329 X |
| 3,222,710 | * | 12/1965 | Potye | 160/345 X |
| 3,296,651 | * | 1/1967 | Baker | 160/348 X |
| 4,115,899 | * | 9/1978 | Ford | 160/345 X |
| 4,230,171 | * | 10/1980 | Baker, Sr. | 160/345 X |
| 4,623,013 | * | 11/1986 | Gross | 160/345 |
| 4,972,895 | * | 11/1990 | Meshaka | 160/330 |
| 5,609,197 | * | 3/1997 | Liao | 160/330 |

OTHER PUBLICATIONS

Cooper Industries, *Accordia–Fold Drapery System,* pp. 1–16 (Aug. 1, 1996).

Cooper Industries, *Ripplefold Drapery System,* pp. 1–8 (Sep. 1, 1996).

Cooper Industries, *Architectural Drapery System,* pp. 1–28 (Aug. 1, 1996).

* cited by examiner

*Primary Examiner*—Daniel P. Stodola
*Assistant Examiner*—Hugh B. Thompson
(74) *Attorney, Agent, or Firm*—Walker, McKenzie & Walker, P.C.

(57) ABSTRACT

A drapery system comprising, in combination, an elongated track; a carrier slidably attached to the track, the carrier having a snap member; a connector including a body member, an arm member attached to the body member, and a snap member attached to the arm member thereof and removably secured to the snap member of the carrier; and a drapery panel including an upper end attached to the body member of the connector.

4 Claims, 2 Drawing Sheets

SNAP MOUNTED DRAPERY SYSTEM

CROSS-REFERENCE TO RELATED APPLICATIONS:

This is a continuation-in-part of application Ser. No. 29/081,096, entitled "SNAP TAB MOUNTING BODY FOR PLEATED DRAPERY SYSTEM," filed Dec. 19, 1997, now U.S. Pat. No. D 419,815, issued Feb. 1, 2000. Such specifically enumerated prior application is hereby incorporated herein by reference.

STATEMENT RE FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

The present invention relates, in general, to drapes or curtains, and more specifically to a system including an elongated track; a carrier slidably attached to the track; the carrier having a snap member; a connector including a body member, an arm member attached to the body member, and a snap member attached to the arm member thereof and removably secured to the snap member of the carrier; and a drapery panel including an upper end attached to the body member of the connector.

2. Information Disclosure Statement

Common drapery and curtain systems typically include an elongated curtain rod or track for extending across a window opening or the like; one or more drapery or curtain panels (e.g., rectangular pieces of fabric); and a plurality of mounting means for slidably mounting the top of each drapery panel to the curtain rod. The mounting means often consist of hook members having a first hook portion for hooking to the top of a drapery panel, and having a second hook portion for hooking to a carrier that is slidably mounted to the curtain rod or track. Certain drapery system have used snaps rather than hooks to attach the drapery panels to the carriers. In the Accordion-Fold and Ripplefold drapery systems (Cooper Industries, Inc. Kirsch, Sturgis, Mich. 49091), a length of tape having a plurality of spaced-apart snaps is sewn across the top of the drapery panels, and carriers having coacting snaps are slidably mounted the tracks to allowing the drapery panels to be easily snapped to and un-snapped from the tracks.

Nothing in the known prior art discloses or suggests the present invention. More specifically, nothing in the known prior art discloses or suggests a drapery system comprising, in combination, an elongated track; a carrier slidably attached to the track, the carrier having a snap member; a connector including a body member, an arm member attached to the body member, and a snap member attached to the arm member thereof and removably secured to the snap member of the carrier; and a drapery panel including an upper end attached to the body member of the connector wherein top edges of the body member, the elongated track, and the panel are aligned.

BRIEF SUMMARY OF THE INVENTION

The present invention provides a drapery system comprising, in combination, an elongated track; a carrier slidably attached to the track, the carrier having a snap member; a connector including a body member, an arm member attached to the body member, and a snap member attached to the arm member thereof and removably secured to the snap member of the carrier; and a drapery panel including an upper end attached to the body member of the connector.

DETAILED DESCRIPTION OF THE INVENTION

Figure 1:
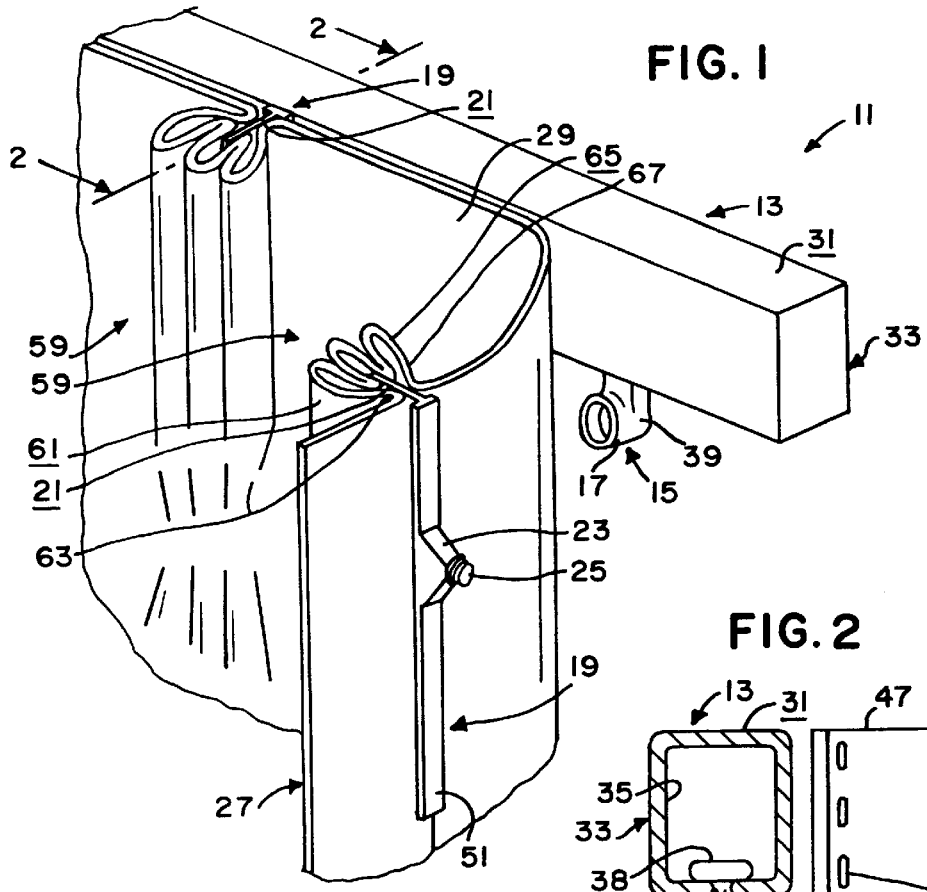
FIG. 1 is a somewhat diagrammatic perspective view of the drapery system of the present invention.

A preferred embodiment of the drapery system of the present invention is shown in FIGS. 1–7, and identified by the numeral 11. The drapery system 11 includes an elongated track 13 for extending across a window opening or the like; at least one and preferably a plurality of carriers 15 slidably attached to the track 13, each carrier 15 having a snap member 17; at least one and preferably a plurality of novel connectors 19, each connector 19 including a body member 21, an arm member 23 attached to the body member 21, and a snap member 25 attached to the arm member 23 thereof and removably secured to the snap member 17 of a carrier 15; and at least one drapery or curtain panel 27 including an upper end 29 attached to the body member 21 of at least one connectors 19.

Figure 2:
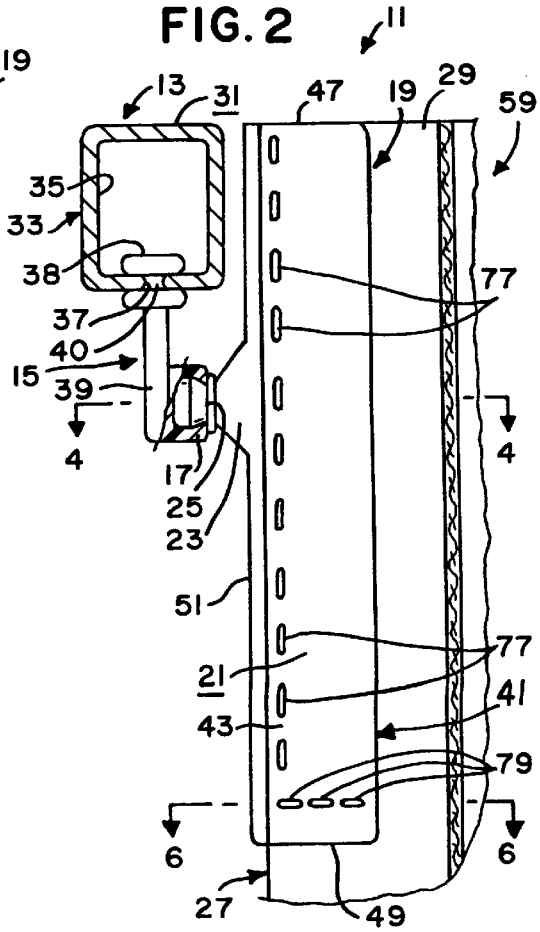
FIG. 2 is a sectional view substantially as taken on line 2—2 of FIG. 1, on a somewhat enlarged scale and with portions broken away for clarity.
Figure 3:
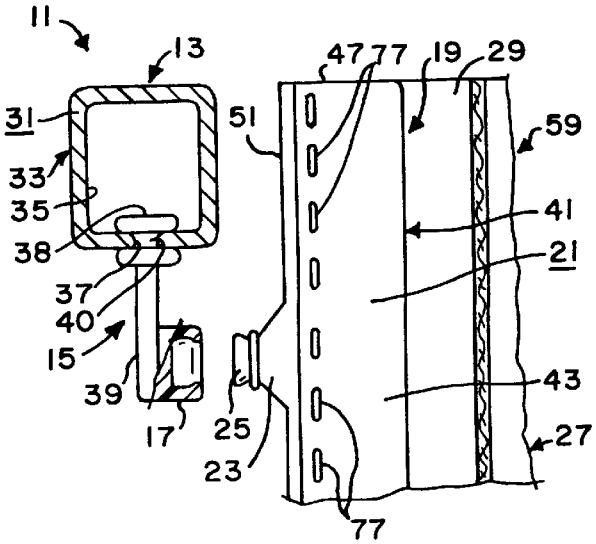
FIG. 3 is a sectional view similar to the upper end FIG. 2 but showing the snap members un-snapped.
Figure 4:
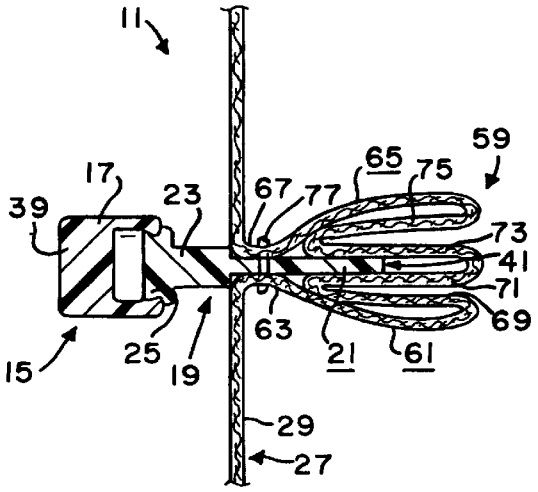
FIG. 4 is a sectional view substantially as taken on line 4—4 of FIG. 2, on a somewhat enlarged scale and with portions broken away for clarity.
Figure 5:
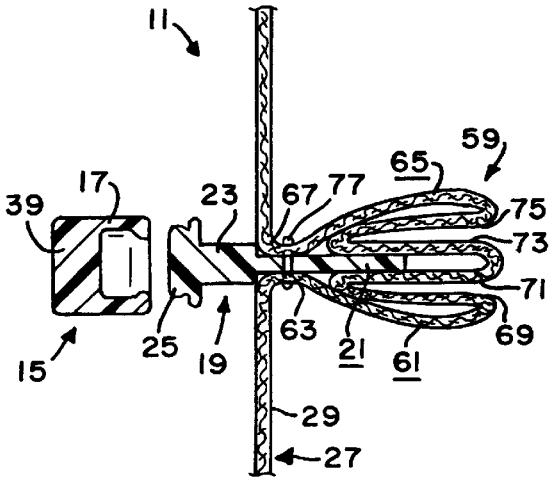
FIG. 5 is a sectional view similar to the upper end FIG. 4 but showing the snap members un-snapped.
Figure 7:
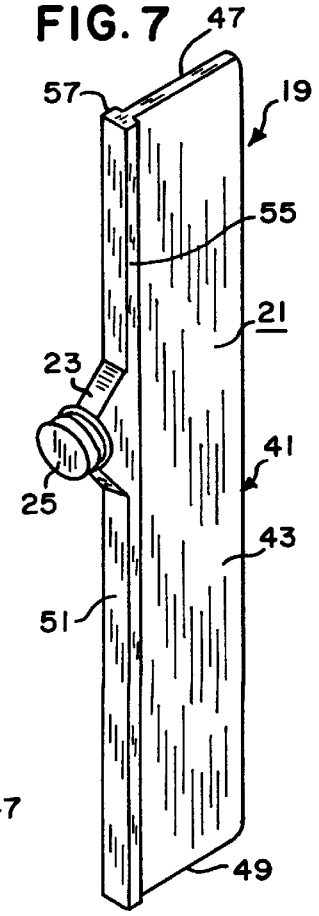
FIG. 7 is a perspective view of a connector of the drapery system of the present invention.
Figure 6:
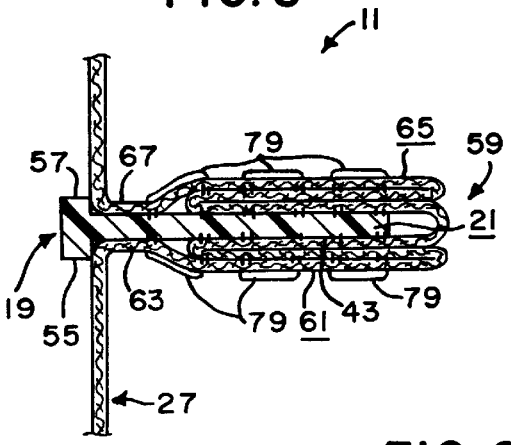
FIG. 6 is a sectional view substantially as taken on line 6—6 of FIG. 2, on a somewhat enlarged scale and with portions broken away for clarity.
Figure 8:
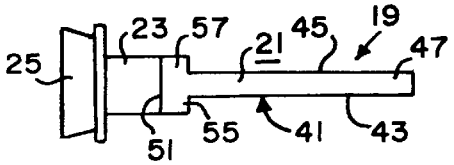
FIG. 8 is a top plan view of the connector of FIG. 7 on a somewhat enlarged scale.

The track 13 typically includes a body 31 having an exterior surface 33, a hollow interior 35, and a keyway 37 extending between the exterior surface 33 and the hollow interior 35 as clearly shown in FIGS. 2 and 3. For example, the keyway 37 may consist of a slot extending through the bottom portion of the exterior surface 33 of the body 31 of the track 13 into the hollow interior 33 of the body 31 of the track 13, along substantially the entire length of the track 13.

Each carriage 15 preferably includes a upper end or head 38 located within the hollow interior 33 of the body 31 of the track 13, a lower end or body 39 located below the keyway 37 of the body 31 of the track 13, and a neck 40 joining the head 38 and body 39 and slidably positioned within the keyway 37 of the body 31 of the track 13. The head 38 is larger in width that the keyway 37 as clearly shown in FIGS. 2 and 3 to secure the carrier 15 to the track 13 as will now be apparent to those skilled in the art. The snap member 17 is preferably part of the body 39, and preferably consist of a female snap member (i.e., a cavity).

The body member 21 of each connector 19 preferably includes a flat, rectangular panel 41 with a first side 43 and a second side 45 that is parallel to the first side 43, a top edge 47, a bottom edge 49, a front edge 51, a rear edge 53, a first flange 55 extending outward of the first side 43 along the length of the front edge 51, and a second flange 57 extending outward of the second side 45 along the length of the front edge 51.

The arm member 23 of each connector 19 preferably extends from the front edge 51 of the panel 41 of the body member 21 thereof between the top and bottom edges 47, 49 thereof. The snap member 25 of each connector 19 is preferably attached to the distal end of the arm member 23 thereof, and preferably consist of a male snap member (i.e., a projection) sized and shaped to be snapped into and out of a coacting snap member 17 of a carrier 15 as will now be apparent to those skilled in the art.

The upper end 29 of the drapery panel 27 preferably has a plurality of pleats 59 therein. Each of the pleats 59 includes a first panel 61 having an end 63 sewn to the first side 43 of the body member 21 of a connector 19 adjacent and along the length the first flange 55 thereof. Each of the pleats 59 includes a second panel 65 having an end 67 sewn to the second side 45 of the body member 21 of a connector 19 adjacent and along the length of the second flange 57 thereof. As clearly shown in FIGS. 1 and 4–6, each pleat 59 may consist of a three-fold pleat, and may include a third panel 69, a fourth panel 71, a fifth panel 73, and a sixth panel 75 joined at opposite ends to one another and to the first and second panels 61, 65 as clearly shown in FIGS. 1 and 4–6. A first line of stitches 77 extend through the first and second panels 61, 65 and through the panel 41 of the body member 21 of a connector 19 adjacent, substantially parallel to, and along the length of the flanges 55, 57 as clearly indicated in FIGS. 2–6 for securing each pleat 59 to a connector 19. A second line of stitches 79 preferably extend through all six panels 61, 65, 69, 71, 73, 75 and through the panel 41 of the body member 21 of a connector adjacent, substantially parallel to, and along the length of the bottom edge 49 thereof.

The track and carriers 13, 15 may be constructed in various manners and out of various materials as will now be apparent to those skilled in the art. Thus, for example, the main portion of the track 13 can be extruded or otherwise constructed out of a plastic, metal, etc, in various sizes to fit a range of typical windows, or may be custom-designed for a specific window, etc., with end plates provided for closing the opposite ends thereof. Similarly, the carriers 15 may be molded out of plastic or the like for use with a specific track 13, etc. Further, the track and carriers 13, 15 could be off-the-shelf items such as, for example, the 94001 Series cord draw track or the 94003 Series hand draw track, and the 92140 Series snap carrier used in the Ripplefold drapery system (Cooper Industries, Inc. Kirsch, Sturgis, Minn. 49091).

The connectors 19 may be constructed in various manners and out of various materials. for example, each connector 19 may be molded or otherwise or otherwise constructed as a one-piece, integral unit out of plastic, etc, in various sizes to fit the coacting carriers 15, with the body member 21 sufficiently soft, etc., to allow the lines of stitches 77, 79 to be sewn therethrough.

The drapery panel 27 may be constructed in various manners and out of various materials as will now be apparent to those skilled in the art. Thus, for example, the drapery panel 27 may be constructed out of a face layer of material and a liner layer of material sewn together to form a panel of the desired shape and size, etc., as will now be apparent to those skilled in the art.

As thus constructed and used, the present invention provides a drapery system with a snap tab or connector that can be easily sewn into a pleat of a drapery panel, that aids in the formation of such pleats, and that allows the drapery panel to be easily snapped onto or off of the drapery track, etc.

Although the present invention has been described and illustrated with respect to a preferred embodiment and a preferred use therefor, it is not to be so limited since modifications and changes can be made therein which are within the full intended scope of the invention.

What is claimed is:

1. A drapery system comprising, in combination:

(a) an elongated track having a top edge;

(b) a carrier slidably attached to said track, said carrier having a snap member;

(c) an elongated connector including a body member, an arm member attached to said body member, and a snap member attached to said arm member thereof and removably secured to said snap member of said carrier; said body member of said elongated connector having a top edge; and (d) a drapery panel including an upper end attached to said body member of said connector; said upper end of said drapery panel having a top edge aligned with said top edge of said body member of said elongated connector and said top edge of said elongated track.

2. The drapery system of claim 1 in which said body member of said connector includes a flat, rectangular panel with parallel first and second sides, a bottom edge, a front edge, a rear edge, a first flange extending outward of said first side along the length of said front edge, and a second flange extending outward of said second side along the length of said front edge; said arm member of said connector extending from said front edge of said panel of said body member of said connector between said top and bottom edges thereof; and in which said upper end of said drapery panel has a plurality of pleats therein; each of said pleats including a first panel having an end sewn to said first side of said body member of said connector adjacent and along the length said first flange thereof; each of said pleats including a second panel having an end sewn to said second side of said body member of said connector adjacent and along the length of said second flange thereof.

3. The drapery system of claim 1 in which said body member of said connector includes a front edge positioned between said elongated track and said drapery panel.

4. A drapery system comprising, in combination:

(a) an elongated track having a top edge and including a body having an exterior surface, a hollow interior, and a keyway extending between said exterior surface and said hollow interior surface;

(b) a plurality of carriers slidably attached to said track; each of said carriers including a body having a first end and a second end; said first end of said body of each of said carriers having a head positioned within said hollow interior of said body of said track, and having a neck extending through said keyway of said track; said second end of said body of each of said carriers having a snap member attached to said neck of said first end thereof;

(c) a plurality of elongated connectors; each of said connectors including a body member having a flat, rectangular panel with parallel first and second sides, a top edge, a bottom edge, a front edge, a rear edge, a first flange extending outward of said first side along the length of said front edge, and a second flange extending outward of said second side along the length of said front edge; each of said connectors including an arm member extending from said front edge of said body member thereof between said top and bottom edges of said body member thereof; each of said connectors including a snap member attached to said arm member thereof and removably secured to said snap member of one of said carriers; and (d) a drapery panel including an upper end attached to said body member of said connector; said upper end of said drapery panel having a top edge aligned with said top edge of said body member of said connector and said top edge of said elongated track, and having a plurality of pleats therein; each of said pleats including a first panel having an end sewn to said first side of said body member of one of said connectors adjacent and along the length said first flange thereof; each of said pleats including a second panel having an end sewn to said second side of said body member of said one of said connectors adjacent and along the length of said second flange thereof; said front edge of each of said connectors being positioned between said elongated track and said drapery panel.

* * * * *